US006273682B1

(12) United States Patent
Lee

(10) Patent No.: US 6,273,682 B1
(45) Date of Patent: Aug. 14, 2001

(54) TURBINE BLADE WITH PREFERENTIALLY-COOLED TRAILING EDGE PRESSURE WALL

(75) Inventor: Ching-Pang Lee, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/379,022

(22) Filed: Aug. 23, 1999

(51) Int. Cl.[7] ..... F01D 5/18
(52) U.S. Cl. ..... 416/97 R; 416/96 R; 415/115
(58) Field of Search ..... 415/115; 416/97 R, 416/96 R, 96 A, 97 A, 95

(56) References Cited

U.S. PATENT DOCUMENTS

| | | | | |
|---|---|---|---|---|
| 4,180,373 | | 12/1979 | Moore et al. | 416/97 R |
| 4,515,526 | | 5/1985 | Levengood | 416/96 R |
| 4,940,388 | * | 7/1990 | Lilleker et al. | 416/97 R |
| 5,232,343 | | 8/1993 | Butts | 416/97 R |
| 5,306,401 | | 4/1994 | Fierkens et al. | 204/129 |
| 5,468,125 | | 11/1995 | Okpara et al. | 416/97 R |
| 5,472,316 | * | 12/1995 | Taslim et al. | 416/96 R |
| 5,681,144 | | 10/1997 | Spring et al. | 416/97 R |
| 5,695,320 | | 12/1997 | Kercher | 416/97 R |
| 5,695,321 | | 12/1997 | Kercher | 416/97 R |
| 5,695,322 | | 12/1997 | Jacobson et al. | 416/97 R |
| 5,700,132 | | 12/1997 | Lampes et al. | 416/97 R |
| 5,738,493 | | 4/1998 | Lee et al. | 416/97 R |
| 5,797,726 | | 8/1998 | Lee | 416/96 R |

* cited by examiner

*Primary Examiner*—Edward K. Look
*Assistant Examiner*—Richard Woo
(74) *Attorney, Agent, or Firm*—Andrew C. Hess; Rodney M. Young

(57) ABSTRACT

An air-cooled airfoil whose surfaces adjacent its trailing edge are not equally cooled in order to compensate for unequal heating of the pressure and suction walls near the trailing edge. The airfoil is formed to have a cooling passage defined by and between the pressure and suction walls at the airfoil trailing edge. The interior surface of the suction wall is formed to be substantially smooth and uninterrupted, while the interior surface of the pressure wall is formed to include surface features that project into the cooling passage to cause preferential convective cooling of the pressure wall as compared to the suction wall when air flows through the cooling passage.

15 Claims, 1 Drawing Sheet

TURBINE BLADE WITH PREFERENTIALLY-COOLED TRAILING EDGE PRESSURE WALL

FIELD OF THE INVENTION

The present invention relates to air-cooled airfoils of turbomachinery. More particularly, this invention is directed to a gas turbine engine airfoil equipped with a cooling passage near its trailing edge, in which the cooling passage is configured to preferentially cool the pressure wall of the airfoil for the purpose of reducing a thermal gradient between the pressure and suction walls of the airfoil.

BACKGROUND OF THE INVENTION

Higher operating temperatures for gas turbine engines are continuously sought in order to increase their efficiency. However, as operating temperatures increase, the high temperature properties of the engine components must correspondingly increase. While significant advances have been achieved through formulation of iron, nickel and cobalt-base superalloys, the high temperature properties of such alloys are often insufficient to withstand long exposures to operating temperatures within the turbine, combustor and augmentor sections of some high-performance gas turbine engines. As a result, internal cooling of components such as turbine blades (buckets) and nozzles (vanes) is generally necessary, and is often employed in combination with a thermal barrier coating (TBC) system that thermally protects their exterior surfaces. Effective internal cooling of turbine blades and nozzles often requires a complex cooling scheme in which bleed air is forced through serpentine passages within the airfoil and then discharged through carefully configured cooling holes at the airfoil trailing edge, and frequently also film cooling holes at the airfoil leading edge and/or cooling holes at the blade tip.

The performance of a turbine airfoil is directly related to the ability to provide a generally uniform surface temperature with a limited amount of cooling air. To promote convective cooling of the airfoil interior, it is conventional to cast turbulators, such as ribs or other surface features, in the interior surfaces that define the cooling passages. With film cooling holes, the size, shape and placement of the turbulators determine the amount and distribution of air flow through the airfoil cooling circuit and across the external surfaces of the airfoil downstream of the film cooling holes, and as such can be effective in significantly reducing the service temperature of the airfoil. Turbulators are typically employed throughout the interior cooling passages of an airfoil in order to promote cooling. To maximize heat transfer efficiency, turbulators are often formed on the interior surfaces of the airfoil sidewalls, often termed the pressure and suction walls, the former of which has a generally concave exterior profile while the latter has a generally convex exterior profile.

While cooling circuits, cooling holes and turbulators have been developed that significantly increase the maximum operating temperatures sustainable by turbomachinery airfoils, further improvements would be desirable in order to further extend airfoil life and increase engine efficiency.

SUMMARY OF THE INVENTION

According to the present invention, there is provided an air-cooled airfoil whose surfaces adjacent the airfoil trailing edge are not equally cooled in order to compensate for operating conditions in which unequal heat loads are imposed on the pressure and suction sidewalls near the trailing edge. The invention is generally based on the determination that the external heat loads imposed by the hot combustion gases on the exterior airfoil surfaces vary from location to location, and that a significantly hotter wall temperature can occur on the pressure wall as compared to the suction wall near the trailing edge of a turbomachine airfoil. The result is a large thermal gradient at the trailing edge that can significantly promote thermal stresses, leading to cracks in the pressure wall near the trailing edge.

To compensate for this heat load imbalance, the airfoil of this invention is formed to have a cooling passage defined by interior surfaces of the pressure and suction walls at the airfoil trailing edge, with the interior surface of the suction wall being substantially smooth and uninterrupted. In contrast, the opposing interior surface of the pressure wall is formed to include surface features that project into the cooling passage to cause preferential convective cooling of the pressure wall as compared to the suction wall when air flows through the cooling passage. As a result, the present invention is able to achieve more uniform airfoil wall temperatures at the trailing edge by intentionally promoting heat transfer from the pressure wall over the suction wall.

Other objects and advantages of this invention will be better appreciated from the following detailed description.

DETAILED DESCRIPTION OF THE INVENTION

Figure 1:
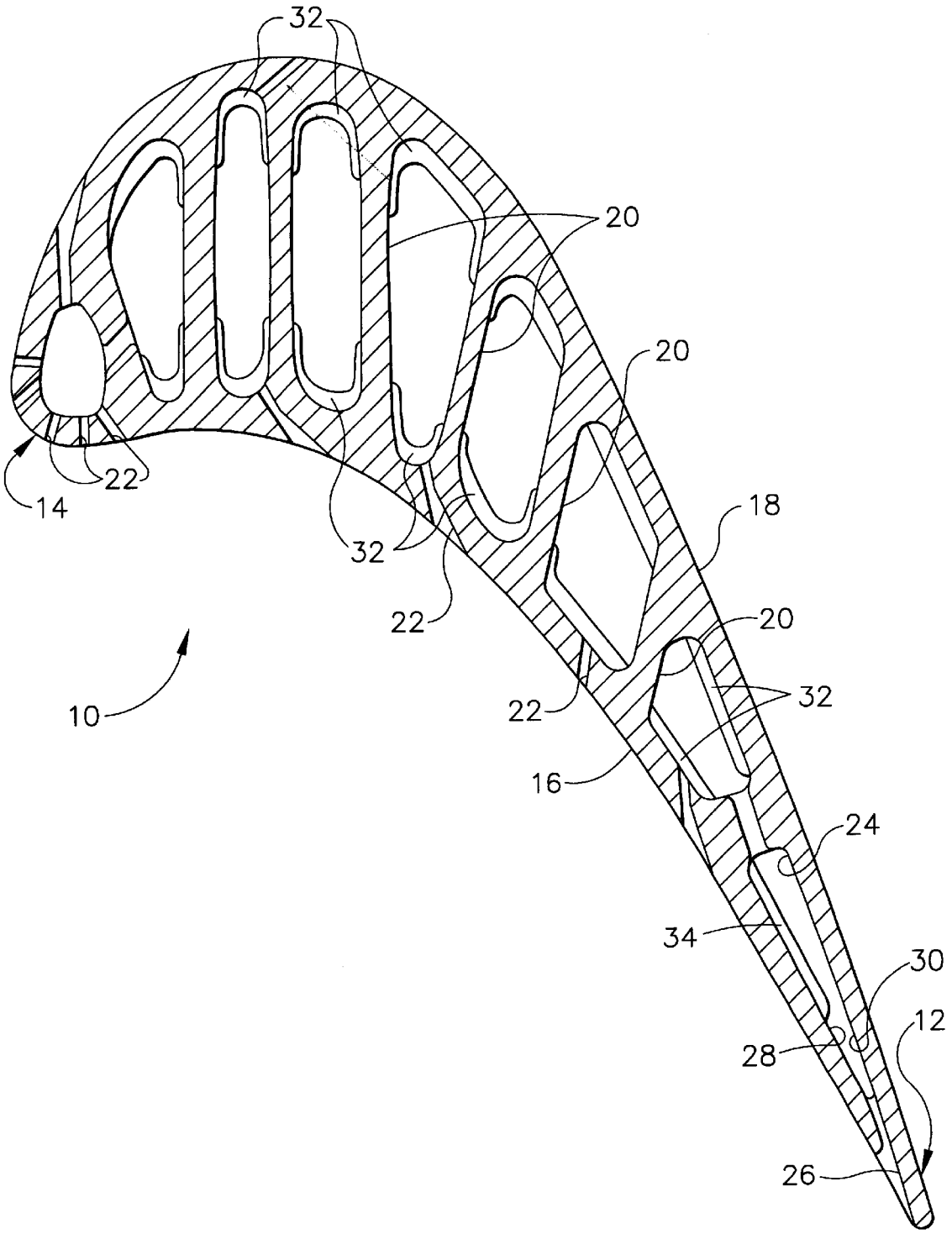
FIG. 1 is a cross-sectional view of an airfoil having a trailing edge cooling passage configured with turbulators on only the interior surface of the pressure wall in accordance with a preferred embodiment of this invention.

The present invention will be described in reference to an airfoil 10 shown in cross-section in FIG. 1. While the airfoil 10 is illustrated as having a particular configuration, the invention is generally applicable to a variety of air-cooled airfoil components that operate within the thermally hostile environment of turbomachinery. Notable examples of such components include the high and low pressure turbine nozzles and blades of gas turbine engines.

As represented in FIG. 1, the airfoil 10 has trailing and leading edges 12 and 14, a generally concave pressure wall 16, and a generally convex suction wall 18. A number of cooling cavities 20 are cast within the airfoil 10, some of which are equipped with film cooling holes 22 through which cooling air flow within the cavities 20 is discharged from the airfoil 10. As is conventional, the cooling cavities 20 can be interconnected to form a serpentine cooling circuit through the airfoil 10, though other cooling circuit configurations are possible. Also shown in FIG. 1 is a cooling passage 24 located nearest the trailing edge 12 of the airfoil 10. The cooling passage 24 can be either a separate radial flow passage or an axial impingement passage connected to the cavities 20. As depicted in FIG. 1, the cooling passage 24 is also equipped with film cooling holes 26 through which cooling air is discharged. The trailing edge cooling passage 24 generally has a large aspect ratio, with long interior surfaces 28 and 30 on both pressure and suction walls 16 and 18, respectively.

According to conventional practice in the art, the airfoil 10 is preferably cast from a high temperature iron, nickel or cobalt-base superalloy. The exterior surfaces of the pressure and suction walls 16 and 18 may be protected by a thermal barrier coating (TBC) system (not shown) composed of a ceramic layer adhered to the exterior surfaces with a bond coat. The bond coat is preferably an oxidation-resistant composition, such as a diffusion aluminide or MCrAlY, that forms an alumina ($Al_2O_3$) layer or scale on its surface during exposure to elevated temperatures. The alumina scale protects the exterior surfaces of the airfoil 10 from oxidation and provides a surface to which the ceramic layer more tenaciously adheres. Zirconia ($ZrO_2$) that is partially or fully stabilized by yttria ($Y_2O_3$), magnesia (MgO) or other oxides is preferred as the material for the ceramic layer.

All but one of the cavities 20 are shown as being equipped with turbulators 32, which may be continuous, broken or V-shaped ribs that are oriented parallel, perpendicular or oblique to the airflow direction through the corresponding cavity 20. Alternatively, the turbulators 32 could be half pins or a roughened surface region on the interior walls of the cavities 20. To promote uniform cooling of the pressure and suction walls 16 and 18 in the vicinity of the cooling cavities 20, the turbulators 32 are conventionally formed to achieve substantially equal convective cooling rates. In contrast, the trailing edge cooling passage 24 has turbulators 34 cast or otherwise formed on only its interior surface 28 associated with the pressure wall 16. The interior surface 30 of the passage 24 associated with the suction wall 18 is shown to be substantially smooth and uninterrupted. As a result, the interior surface 30 of the suction wall 18 is characterized by a significantly lower heat transfer coefficient than that of the pressure wall 16, for example, on the order of about one-half or less of the heat transfer coefficient at the interior surface 28 of the pressure wall 16, depending on the type of turbulators 34 present on the interior surface 28. Consequently, the pressure wall 16 is preferentially cooled by the air flow through the trailing edge cooling passage 24. However, on the basis that the pressure wall 16 of the airfoil 10 is subject to a higher heat load than the suction wall 18 at the trailing edge 12, the effect of preferentially cooling the pressure wall 16 is to achieve more uniform wall temperatures at the trailing edge 12 of the airfoil 10.

According to the invention, by sufficiently reducing the temperature gradient between the pressure and suction walls 16 and 18, the tendency for cracks is significantly reduced and the blade life is prolonged. An additional benefit is that, because of the reduced cooling of the suction wall 18, the temperature rise of the cooling air within the passage 24 is reduced, which promotes heat transfer from the pressure wall 16 as a result of a cooler film temperature within the passage 24. Under conditions where a further reduction of the thermal gradient is required, the protective TBC system can be omitted from the exterior surface of the suction wall 18. For example, the TBC system may be limited to the exterior surface of the pressure wall 16 and the exterior surface of the suction wall 18 away from the trailing edge 12, or limited to just the pressure wall 16, or even the pressure wall 16 adjacent the trailing edge 12.

Under such circumstances, an environmental coating of a diffusion aluminide or an MCrAlY overcoat layer will typically be desired to protect those surfaces unprotected by the TBC system from oxidation and hot corrosion.

While the invention has been described in terms of a preferred embodiment, it is apparent that other forms could be adopted by one skilled in the art. For example, the invention is applicable to airfoils 10 having configurations and cooling circuits that differ from that shown in FIG. 1. Therefore, the scope of the invention is to be limited only by the following claims.

What is claimed is:

1. An air-cooled airfoil having a trailing edge, opposing pressure and suction walls at the trailing edge, and a cooling passage between the pressure and suction walls and defined by interior surfaces of the pressure and suction walls, the interior surface of the suction wall being substantially smooth and uninterrupted, the pressure wall comprising a surface feature on the interior surface thereof that projects into the cooling passage to cause preferential convective cooling of the pressure wall as compared to the suction wall when air flows through the cooling passage.

2. An air-cooled airfoil according to claim 1, wherein the surface feature is a turbulator on the pressure wall and projecting into the cooling passage.

3. An air-cooled airfoil according to claim 1, wherein the surface feature is chosen from the group consisting of half-pins, roughened surface regions, and continuous, broken and V-shaped ribs oriented parallel, perpendicular or oblique to the airflow direction through the passage.

4. An air-cooled airfoil according to claim 1, wherein the airfoil is a turbine blade of a gas turbine engine.

5. An air-cooled airfoil according to claim 1, further comprising a thermal barrier coating on an exterior surface of at least one of the pressure and suction walls.

6. An air-cooled airfoil according to claim 1, further comprising a thermal barrier coating on only an exterior surface of the pressure wall.

7. An air-cooled airfoil according to claim 1, the airfoil further comprising:

a plurality of cooling cavities between the pressure and suction walls, each of the plurality of cooling cavities being defined by interior second surfaces of the pressure and suction walls; and surface features projecting into each of the plurality of cooling cavities from the pressure and suction walls.

8. An air-cooled airfoil according to claim 1, wherein the interior surface of the suction wall is characterized by a heat transfer coefficient that is about one-half or less of the heat transfer coefficient of the interior surface of the pressure wall.

9. An air-cooled gas turbine engine turbine blade having a trailing edge, opposing pressure and suction walls, a plurality of cooling cavities between the pressure and suction walls, surface features projecting into each of the plurality of cooling cavities from the pressure and suction walls, and a trailing edge cooling passage at the trailing edge and defined by interior surfaces of the pressure and suction walls, the interior surface of the trailing edge cooling passage being substantially smooth and uninterrupted, the pressure wall comprising a surface feature on the interior surface thereof that projects into the trailing edge cooling passage to cause preferential convective cooling of the pressure wall as compared to the suction wall when air flows through the trailing edge cooling passage.

10. An air-cooled gas turbine engine turbine blade according to claim 9, wherein the surface feature is a turbulator on the pressure wall and projecting into the cooling passage.

11. An air-cooled gas turbine engine turbine blade according to claim 9, wherein the surface feature is chosen from the group consisting of half-pins, roughened surface regions, and continuous, broken and V-shaped ribs oriented parallel, perpendicular or oblique to the airflow direction through the passage.

12. An air-cooled gas turbine engine turbine blade according to claim 9, further comprising a thermal barrier coating on an exterior surface of at least one of the pressure and suction walls.

13. An air-cooled gas turbine engine turbine blade according to claim 9, further comprising a thermal barrier coating on only an exterior surface of the pressure wall.

14. An air-cooled gas turbine engine turbine blade according to claim 9, wherein the interior surface of the suction wall is characterized by a heat transfer coefficient that is one-half or less of the heat transfer coefficient of the interior surface of the pressure wall.

15. An air-cooled gas turbine engine turbine blade having a trailing edge, opposing pressure and suction walls, a plurality of cooling cavities between the pressure and suction walls, surface features projecting into each of the plurality of cooling cavities from the pressure and suction walls, and a trailing edge cooling passage at the trailing edge and defined by interior surfaces of the pressure and suction walls, the pressure wall comprising a plurality of turbulators on the interior surface thereof that project into the trailing edge cooling passage, the interior surface of the trailing edge cooling passage being free of any turbulators such that the interior surface of the suction wall is characterized by a heat transfer coefficient that is one-half or less of the heat transfer coefficient of the interior surface of the pressure wall, causing preferential convective cooling of the pressure wall as compared to the suction wall when air flows through the trailing edge cooling passage.

* * * * *